United States Patent [19]

Callahan et al.

[11] Patent Number: 4,550,276

[45] Date of Patent: Oct. 29, 1985

[54] BUSS STRUCTURES FOR MULTISCENE MANUAL LIGHTING CONSOLES

[76] Inventors: Michael Callahan, 201 W. 85th St., New York, N.Y. 10024; Robert M. Goddard, 330 First Ave., New York, N.Y. 10009

[21] Appl. No.: 388,230

[22] Filed: Jun. 14, 1982

[51] Int. Cl.[4] ..... H05B 37/00; H05B 39/00; H05B 41/00

[52] U.S. Cl. ..... 315/312; 315/314; 315/316; 315/294; 315/299; 330/298; 361/18

[58] Field of Search ..... 315/293, 294, 295, 312, 315/299, 314, 315, 316; 330/298; 361/18

[56] References Cited

U.S. PATENT DOCUMENTS

| | | | |
|---|---|---|---|
| 3,049,645 | 8/1962 | Skirpan | 315/316 |
| 3,277,386 | 10/1966 | Miyazawa | 330/298 |
| 3,448,338 | 6/1969 | Bentham et al. | 315/295 |
| 3,534,242 | 10/1970 | Skirpan | 321/16 |
| 3,706,913 | 12/1972 | Malatchi | 315/295 X |
| 3,763,394 | 10/1973 | Blanchard | 315/294 |
| 3,859,561 | 1/1975 | Gilbreath et al. | 315/293 |
| 3,898,643 | 8/1975 | Ettlinger | 340/324 A |
| 3,946,273 | 3/1976 | Goddard | 315/315 |
| 4,095,139 | 6/1978 | Symonds et al. | 315/153 |
| 4,396,897 | 8/1983 | Scheuermann | 315/293 X |

FOREIGN PATENT DOCUMENTS

| | | | |
|---|---|---|---|
| 2076180 | 11/1981 | United Kingdom | 315/294 |

OTHER PUBLICATIONS

Strand Century 2-Scene, Print and Photos.
Electrosonics Rockboard TM Console, Brochure and Photos.
CAE, Inc. Rainbo TM Console, Brochure and Photos.
Capron Lighting "Eagles" Console Photo.
Capron Lighting "CSN" Console Photos.
Lighting Methods, Ltd. "248" Console Photo.
FM Productions Lighthesizer TM Console Brochure.
Theater Techniques 5-Scene Console Brochure.
Lighting Methods, Ltd. "212" Brochure and Photos.
Advanced Manual Console by the applicants.
"AVO" Console Brochure and Photos.
Strand Century Mantrix TM Console Brochure.
Kliegl Entertainer TM Console Brochure.
Lighting Methods Designer TM Console Brochure.
Berkey Patchman TM Console Brochure.
Electro-Controls Celebrity TM Console Brochure.
E.F.S. Celco Gamma TM Console Brochure.
General Electric Radio City Music Hall Console Photo.
Kliegl Performance TM Console Brochure.
Berkey Channeltrack TM Console Brochure.
Electronics Diversified TAM Console Brochure.
Strand Century Micro-Q TM Console Brochure and Photo.
Kliegl Performer TM Console Brochure.

*Primary Examiner*—Saxfield Chatmon
*Attorney, Agent, or Firm*—Kenyon & Kenyon

[57] ABSTRACT

In a lighting console which provides outputs to dimmers which include master controls for at least two scenes and channel controls for each of a plurality of channels with the channel controls including at least a first and second scene preset potentiometer, the channel controls and master controls cooperating to allow presetting, and which also includes a buss, with one of the preset potentiometers for each of a plurality of the channels connected to the buss and an output from the master controls being used through suitable amplifiers to drive the buss, a plurality of nondestructive current limiting fault isolating devices are provided for each scene, each connected between the master and at least one of the preset potentiometers for that scene. As a result, the effects of a fault causing abnormal currents to flow which develops after the fault isolating means will not disrupt the operation of channel potentiometers connected to other fault isolating means. In addition, the console permits the separation of the assignment selection of potentiometers and the assignment indication of that selection. The console also includes distributed multiplexing devices which reduces the back plane wiring requirements in the console.

39 Claims, 13 Drawing Figures

OUTPUT TO DIMMERS
DISPLAY
SERIAL OUT
DISPLAY LOGIC
OTHER INPUT SIGNALS
OTHER DIGITAL LOGIC
ATTENUATOR
MASTER SWITCHING LOGIC
MASTER SWITCHING LOGIC
MASTER MEMORY
SAMPLE & HOLD OUT SAMPLE
ADDRESS DECODER
IND SCENE 1 DIR
A
B
SCENE 2 DIR
A
B
DATA BUS
SERIAL IN
ADDRESS BUS
ATTENUATOR CONTROL SIGNAL
109
115A
123A
125A
117A
131A
133A
143
169
161
157
171
173
175
177
179
181
183
185
187
189
191
193
194
195
197
199
201
203
205
207
209
211
213
215
217
219
221
223
225

BUSS STRUCTURES FOR MULTISCENE MANUAL LIGHTING CONSOLES

BACKGROUND OF THE INVENTION

This invention relates to theater lighting in general and more particularly to a lighting console which provides increased capability of control, increased reliability, increased serviceability, and increased economy of interfacing manual and memory capabilities, particularly in portable use.

In the area of traditional performance lighting, separate manual consoles and memory consoles have been developed. For a background in the manual multi-scene console, reference can be made to U.S. Pat. No. 3,946,273. Descriptions of computer-based memory systems are well established in the patent art.

While each type has proved useful in certain applications, neither has been found completely satisfactory for the many applications in which both the adaptability provided by manual capability and some form of preset storage are both required. As a result, these applications have required the use of either both a manual console and a separate memory console and a separate memory console, at considerable expense and inconvenience to the operator, or of a new class of hybrid manual/memory console providing both multi-scene manual capability and increasingly elaborate memory and effects subsystems. Such consoles, which are based on traditional manual console design, have problems:

The number of channels to be ccntrolled in the manual scenes is so large that extensive mastering capabilities are required with a consequently large number of possible master assignments for each channel's potentiometers. No satisfactory control for making that assignment which satisfies all of the necessary electronic and human factors criteria is currently known in the art.

These manual sections must be interfaced increasingly with electronic storage systems which require and produce serial data systems which require and produce serial data streams. To date, parallel/serial conversion subsystems have been installed, requiring considerable additional interconnecting wiring.

The electronic complexity of such consoles; the amount of interconnecting wiring; and the degree to which various functions for a single channel are distributed in many different locations within the console have made such consoles less than fully reliable and very difficult to troubleshoot.

Furthermore, in addition to the need for a console which is reliable, particularly when transported with a touring production, there is a need for flexibility in console design. The ideal console should be as large or small as needed for the application without requiring a major electronic redesign and should give operational flexibility.

It is the object of the present invention to produce a console meeting all these needs.

SUMMARY OF THE INVENTION

The present invention provides a lighting console which achieves these and additional objects through number of unique features.

First, the console of the present invention, incorporates strip module construction. That is, each channel, i.e. discrete output to a light or group of lights to be separately controlled, is a separate plug-in module and contains the electronics associated with the channel.

This gives ease of mechanical assembly, allows subsequent expansion, and permits the design of a console to any size requirement. Furthermore, field-servicing is quite simple, since repairs in the field can be accomplished by replacement of the whole strip module with a spare, and the failed strip module sent back to the shop for repair.

The second main feature of the present invention resides in distributed electronics. The strip modules, in addition to being mechanically separate, achieve a great degree of electrical independence. Through the use of various fault isolating techniques and separate control of power supply, a failure in one channel does not spread through the console, temporarily disabling or permanently damaging other channels or sections. This is accomplished by means of various fault-isolating resistors and amplifiers, the amplifiers being fed with their own power supply. This method of console construction gives the further advantage of permitting expansion, since the number of channels in a console is not limited to the power capabilities built into the master amplifiers as has been the case in the past.

The present console provides for the capability of assigning each channel potentiometer to any one of six modes: directly to the scene master; to the submasters, such as Sub A, Sub B, or Sub C; to an Independent buss, or to off. In the past, it had been the practice to combine the switching function and the indication of the selected mode in the same device.

However, no method satisfactory in all respects, has been achieved in the prior art. The present invention solves the master assignment problem by separating the indicating function and the switching function. Thus, in accordance with the present invention, each strip module; i.e. each channel, includes its own seven-segment LED displays driven through a logic device. By using this method, only one set of mode d can selection switches is required for the whole console along with only two "Assign" pushbuttons for each channel (assuming two scenes per channel and a separate assignment possible for each scene). With this arrangement, the operator selects the n desired assignment using the master mode selector switch bank, whereupon all the channel potentiometers to be assigned to that master are assigned by pressing their assign pushbuttons with an indication immediately thereof on associated LED displays.

The present invention also provides independent, control. The ability to switch a channel potentiometer to an r independent buss is an important feature in a lighting controller to simplify difficult cues and to speed an operator's response to the unexpected. Because of the speed with which it is generally necessary to enter independent, it is important ce that the method of doing so be fast and simple. In accordance with the present invention, independent control is provided for the potentiometers in each scene. It is entered by throwing a miniature switch located directly above the affected potentiometer. Furthermore, because of the manner in which the odes: independent control is implemented electronically, the normal, master assignment is unaffected. Simply restoring the independent control to its normal position returns the potentiometer to its normal assignment. It is also possible with the ce. present invention to change a potentiometer's assignment while in the independent mode.

Furthermore, the present console includes the ability to review the assignments of the channel potentiometers of the console and to display other data through what are known as "show me" buttons.

To determine which of the channel potentiometers is assigned to a given mode with particular speed, ease, and accuracy; it is simply necessary to select the appropriate mode on the master mode selector switch bank and then depress the "show me" button and the displays for all potentiometers assigned to other functions will go out. This allows the operator to immediately determine which potentiometers are assigned to that mode by simply noting which displays remain lit. Similarly, the capability is provided for locating, in the same manner, all of the channels in which independent has been selected and further includes the ability to review levels set in a memory system or other data. In the "show me" modes there is no effect on the actual assignment, this being only a display feature.

Also included in the console of the present invention are flash buttons. The flash button permits operation in four modes: safe or off; momentary flash of the channel to the level set by a central "flash" master potentiometer; electronically held, push-on/push-off action with a central reset button useful for setting up an additional "preset" at high speeds; and a "kill" mode in which depresing a channel's flash button flashes it to the level of the flash master while automatically blacking out all other channels.

The console of the present invention also provides additional features. Included is a channel kill switch which disables that channel's potentiometers and flash button. An auxiliary kill switch disables inputs tc the module from sources outside of it, such as the console's memory and effects sections and/or outboard units. This auxiliary kill switch may be used to temporarily delete a channel from stored presets without altering the matrix or memory. An indication through a light-emitting diode is provided when one or both of the kill switches is engaged. In addition, displays are provided to indicate whether the channel is being driven from inputs on the module or from off the module. In addition, there is an indication of the availability of inputs from an external memory board or the like.

In this last regard, the console of the present invention is adapted to interface with onboard or offboard matrix, memory, and effects units. In accordance with the present invention, each strip module has four inputs for levels originating outside the module, whether elsewhere in the console of the present invention or from outboard units. The console of the present invention has further distributed the components necessary for serial conversion to the strip modules, allowing the console of the present invention to both produce and accept serial data streams for use with onboard or outboard memory and effects units and for connection to the dimmers over a serial link, without the traditional necessity for a separate conversion subsystem and the interconnect wiring required to it, with considerable savings in cost and increase in reliability.

DETAILED DESCRIPTION

Figure 1:
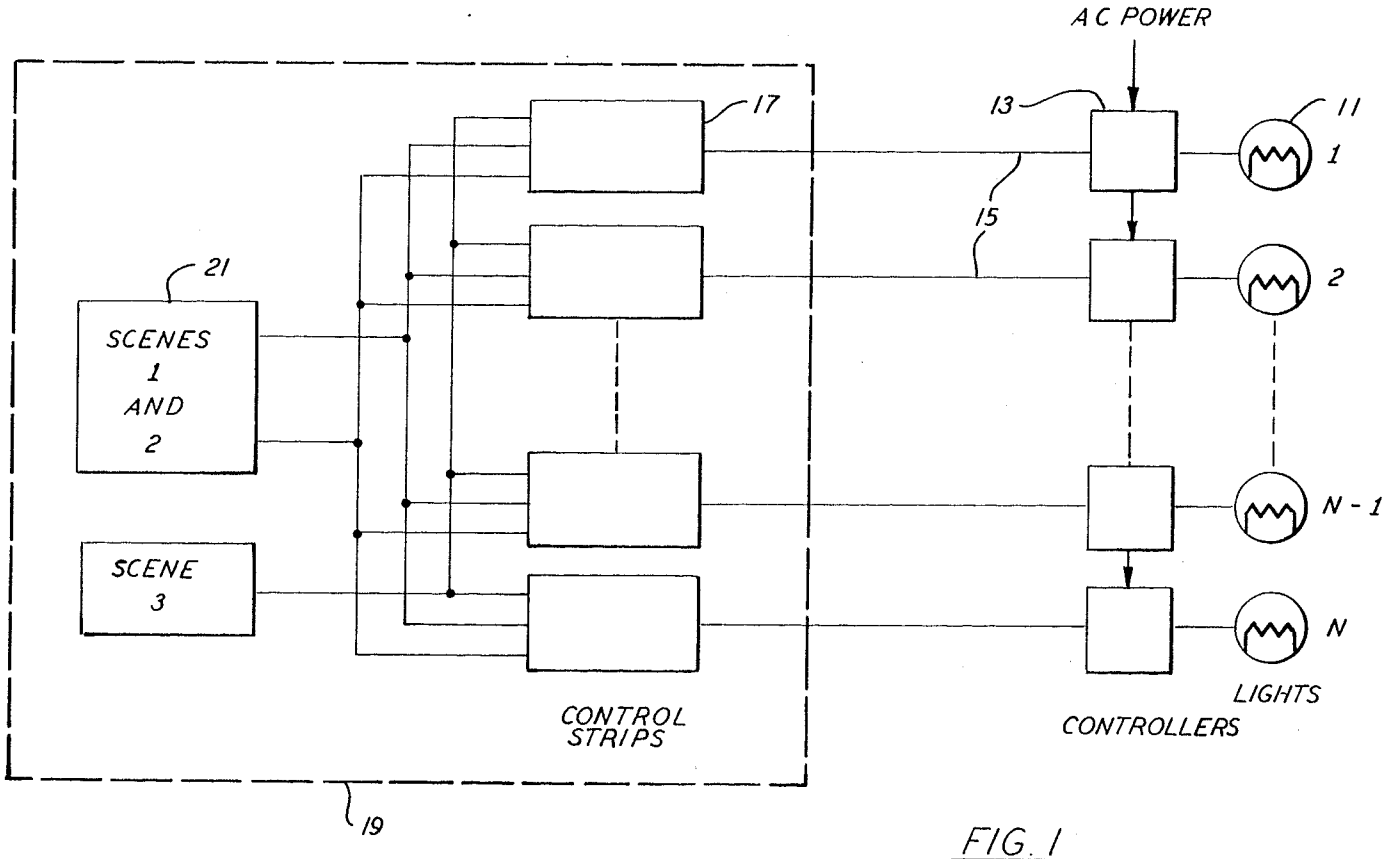
FIG. 1 is an overall block diagram of the console of the present invention.

FIG. 1 is an overall block diagram of the lighting control system of the present invention. At the right of the figure are shown a plurality of n lights 11 to be controlled. Typically, the device according to the present invention might have 64 channels, i.e., control 64 separate lights or groups of lights 11. For each of the lights 11, a dimmer 13 of conventional design is provided. Dimmers 13 receive AC power and provide it in a controlled manner, in accordance with the control input on a line 15, to their associated lights 11. The signal on line 15 is a DC voltage which controls an electronic circuit which in turn controls a triac, SCR or the like. The individual control signals on lines 15 are developed in individual control strip modules 17 on a lighting console 19, one such strip being provided for each channel. As will be seen in more detail below, each strip, in addition to other functions, permits selecting for each of two scenes, scene I and scene II, any one of five master, submaster control inputs developed in a master control portion 21. Master control 21 which will typically include a crossfader for crossfading between scenes I and II. These control outputs will, for example, be provided to scene I and scene II submaster potentiometers, the outputs of which are provided as the inputs to the control strips 17. Naturally, buffering and amplification as necessary will be provided.

Figure 1A:
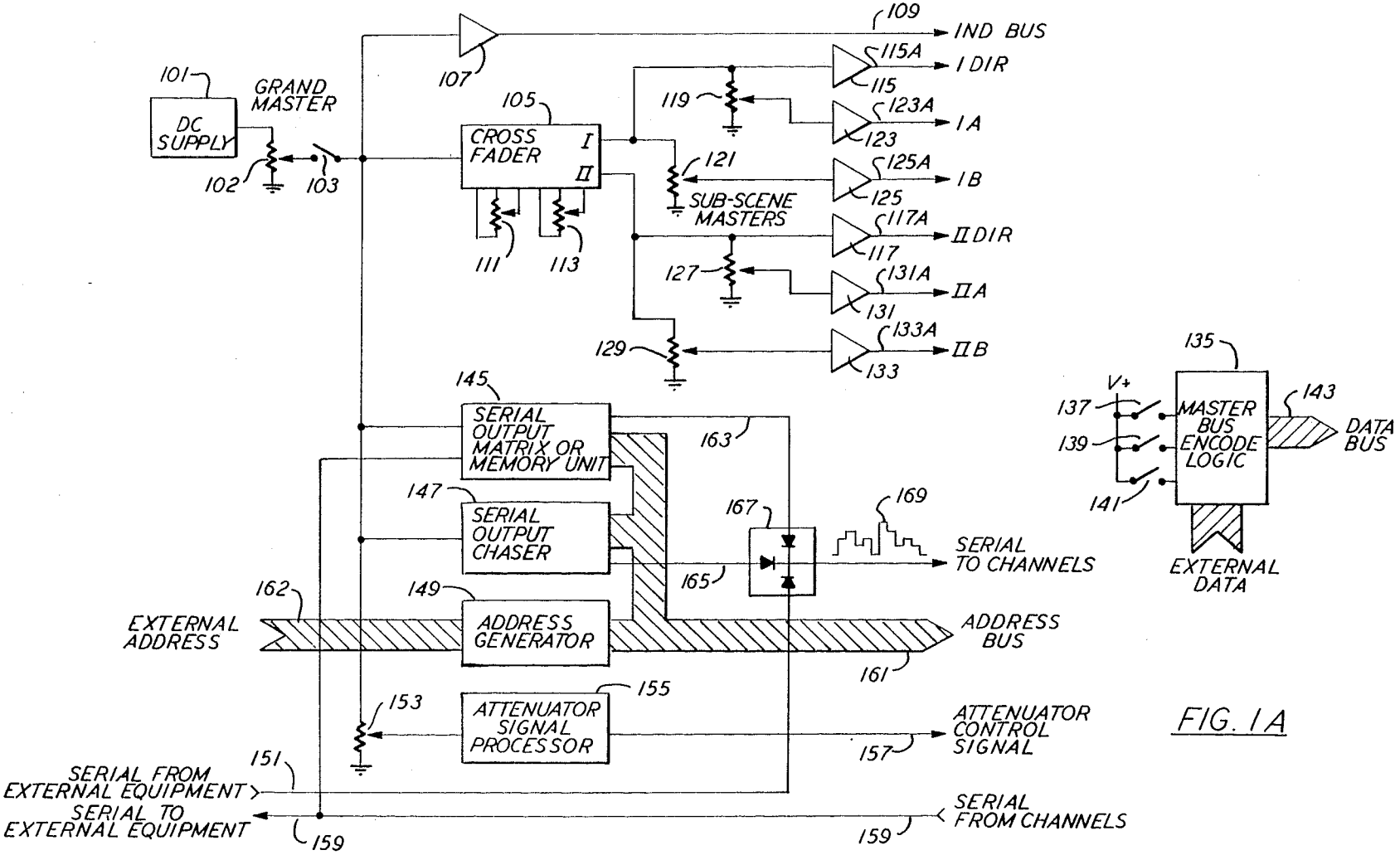
FIG. 1A is a more detailed block diagram of the master section of the console of the present invention.
Figure 1B:
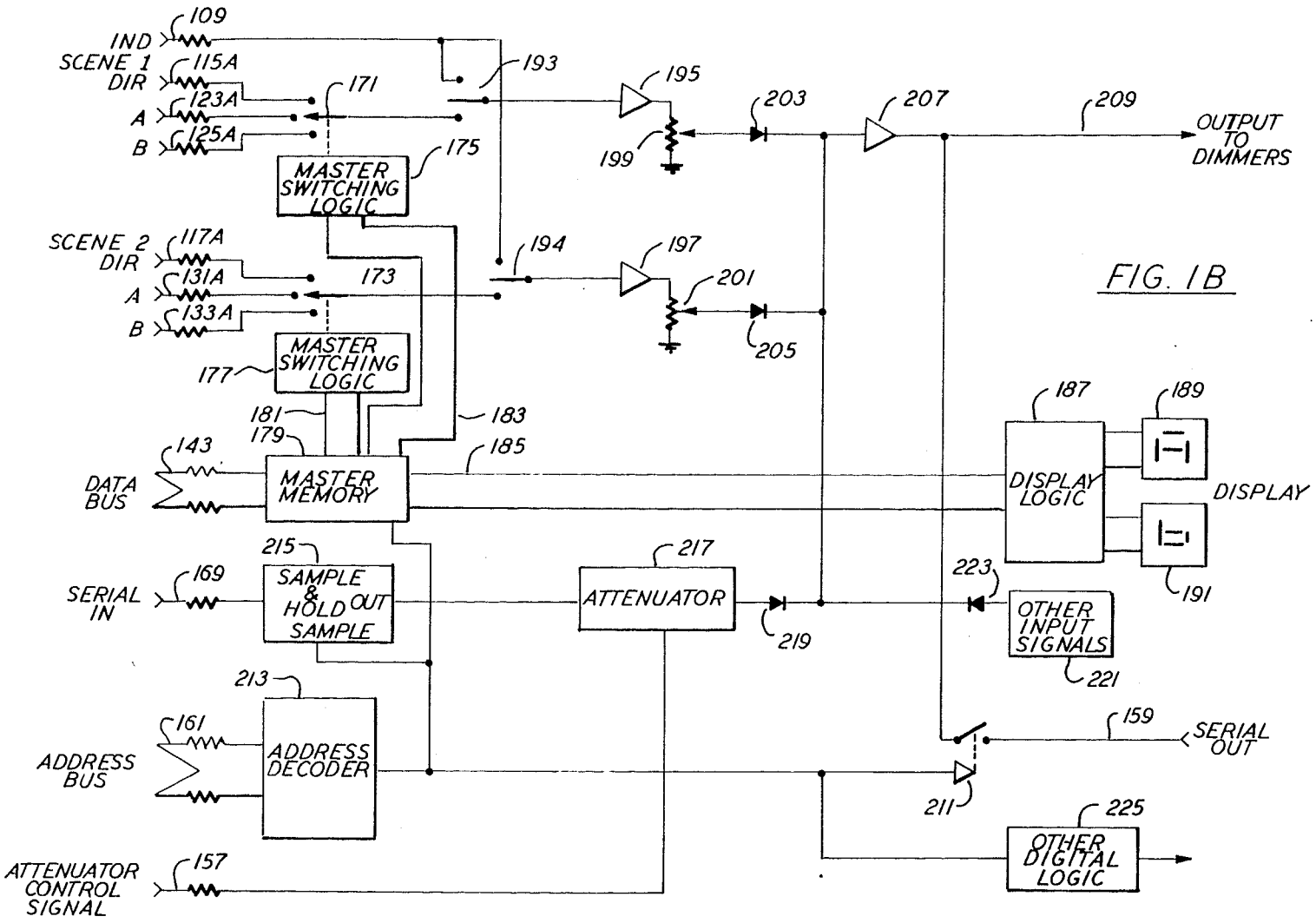
FIG. 1B is a more detailed block diagram of a single channel strip module used in the console of the present invention.

FIGS. 1A and 1B are more detailed block diagrams of the lighting control system of the present invention. FIG. 1A illustrates the basic units contained in the master control 21 of FIG. 1. FIG. 1B illustrates the basic blocks contained in one control strip 17 of FIG. 1.

Referring now to FIG. 1A, the control signal is first generated from the output of a reference DC supply 101. The reference DC supply provides this output to a potentiometer 102 which is the grand master potentiometer. Its output is coupled through a grand master blackout switch 103 to a crossfader 105. It is also coupled to an amplifier 107 which provides an output on what is known as an independent bus 109. The crossfader 105, which comprises a pair of scene master potentiometers 111 and 113, provides outputs for the scenes I and II. One output for scene I is provided directly into an amplifier 115. Similarly one output from scene II is provided into an amplifier 117. Outputs are also provided through submaster A and B potentiometers 119 and 121 to amplifiers 123 and 125 for scene I and through submaster A and B potentiometers 127 and 129 to amplifiers 131 and 133 for scene II. Although only two potentiometers are shown for each scene, at this, the submaster, level, a greater number may be provided.

The present invention also includes encoding logic 135 accepting inputs from the master mode selector switch bank 137, 139 and 141; and providing a parallel output representing the mode selected on buss 143.

The system of the present invention is also usable with presently existing electronic memory systems. These may be full feature stand-alone memory boards well known in this art, or the simpler more specialized sutstitutes which are coming into increasing use. Memory units of this type produce serial output which provides all channel intensity data. When used with traditional consoles, serial to parallel conversion subsystems are required. The discrete outputs of the systems are connected with combining diodes at the channels using individual conductors. To be able to also provide this kind of information but without a large number of interconnecting wires which would otherwise be necessary is desirable. And, the arrangement of the present invention provides such. Thus, as illustrated by FIG. 1A the master control also includes a serial output matrix or memory unit 145, serial output chaser 147, and address generator 149 and provisions for coupling in an external signal on a line 151. In addition, the output from the grand master is coupled through a potentiometer 153 to an attenuator signal processor 155 providing its output on a line 157. Serial data from the channels is provided back on a line 159 which can be multiplexed to dimmers, for example, and is also fed back into the matrix or memory unit to permit storing information which is set up on the individual channels.

Unit 149 is an address generator providing parallel information on the address buss 161. This address information is used to synchronize the operation of the serial encoding and decoding circuitry distributed throughout the console. The address generator's output is further used to synchronize the operation of the matrix or memory unit 145 and the chase/effects unit 147 so that their serial analog outputs on lines 163 and 165 contain the correct channel's level during its sample interval. On one of these lines will be a series of levels such as shown by the waveform of line 169. Each sample interval is associated with a particular channel and the value on the serial line during that interval corresponds to the desired level for that channel. The serial outputs of the memory or matrix 145, the chase unit 147, and the input on line 151 from an external source of serially-encoded level information are combined through diodes in block 167.

Inputs from these sources are provided to the channel modules by means of bus 169 and the address information is distributed on bus 161 and may be treated as an additional scene or scenes. In the event that an external system is connected with the console by means of line 151 then the external system must be synchronized to the console's address generator 149 or the console's address buss 161 connected to that of the external system.

It will be apparent that the functions of address generation and master mode selection can also be accomplished by means of a microprocessor. Provision is made for external address information on a bus 162 which will be coupled through to bus 161 to synchronize with the analog information on line 151. An additional scene or scenes can be provided by means of the serial information just described and provided as outputs on line 169 and addresses on bus 161.

FIG. 1B shows how these various outputs are connected in each of the plurality of channels 17. For each of the two scenes, a direct and two submaster inputs are provided as inputs to switches 171 and 173 respectively. These switches are controlled by respective switching logic 175 and 177 receiving inputs from a master memory device 179 which in turn receives its input from the bus 143. The master memory 179 provides outputs on buses 181 and 183 to switching logic 177 and 175. It also provides an output on bus 185 to display logic 187 which drives displays 189 and 191 displaying respectively the selection for each of the two scenes. The output from switches 171 and 173 is coupled to switches 193 and 194. These switches respectively permit switching between one of the submasters or the direct crossfader output and the independent bus 109. The signal, whether it be from the independent bus or one of the master or submaster controls, is then coupled through an amplifier 195 or 197 to a respective scene preset pot (potentiometer) 199 or 201. These outputs are combined through diodes 203 and 205 into an output amplifier 207 which provides its output on line 209 to dimmers. This output is also coupled through a switch 211, enabled by an address decoder 213 coupled to the address bus 161, to provide serial analog output information on line 159 when that particular channel is being addressed by the address bus 161, permitting feedback to the matrix or memory unit 145 of FIG. 1A and/or serial dimmer control.

The serial analog input data on line 169 is sampled and held in a sample and hold device 215 which is enabled by the same output from address decoder 213. The attenuator control signal on line 157 is coupled into an attenuator 217, the output of which is coupled through a diode 219 to the amplifier 207. Furthermore, it is indicated that there may be a source 221 of other signals coupled through a diode 223 to amplifier 207. In addition, the address decoder output may be used to enable other digital logic 225.

In general, operation is as follows in setting up the assignment of channel potentiometers on the console. The first mode, for example, direct, might be selected using the master mode assignment switch bank 137, 139, 141 and that mode's designation encoded by the logic 135. Then all of the channels it is desired to connect to direct are selected by pressing the appropriate assign switches which will cause their master switches 175 and 177 to set their switches 171 and 173 to line 115*a* and 117*a* as required and keep them there. The same is done for the submasters A and B for example. When this is completed, each of the channel potentiometers will have been assigned to a particular master bus. In addition, display logic will display the assignment which has been selected. For example, in FIG. 1B, it is shown that scene I has been assigned to submaster A and scene II to submaster B. Subsequently, then as the crossfader, and subscene masters are operated, the proper channels will follow as desired.

In addition, when it is desired to input information of a serial nature, addresses are generated in serial, one address corresponding to each channel. This occurs on the address bus 161. At the same time, an analog level is coupled out to line 169, a separate level for each channel. These levels appear on line 169 of all channels at the input to the sample and hold circuits 215. However, only when the address of that channel is decoded by address decoder 213 does that channel sample its proper level to be provided as an output through the attenuator 217 to the output amplifier 207. The attenuation control signal on line 157 can be a pulse code modulated signal of the type described in U.S. Pat. No. 3,946,273. This will then be used to attenuate the signal output of the sample and hold circuit. Other types of attenuators can be used as will be seen below.

In FIG. 1B essentially all of the inputs are coupled through input resistors. The purpose of these resistors is to aid in fault isolation in a manner that will be seen below in connection with FIGS. 4 and 5.

Figure 2A:
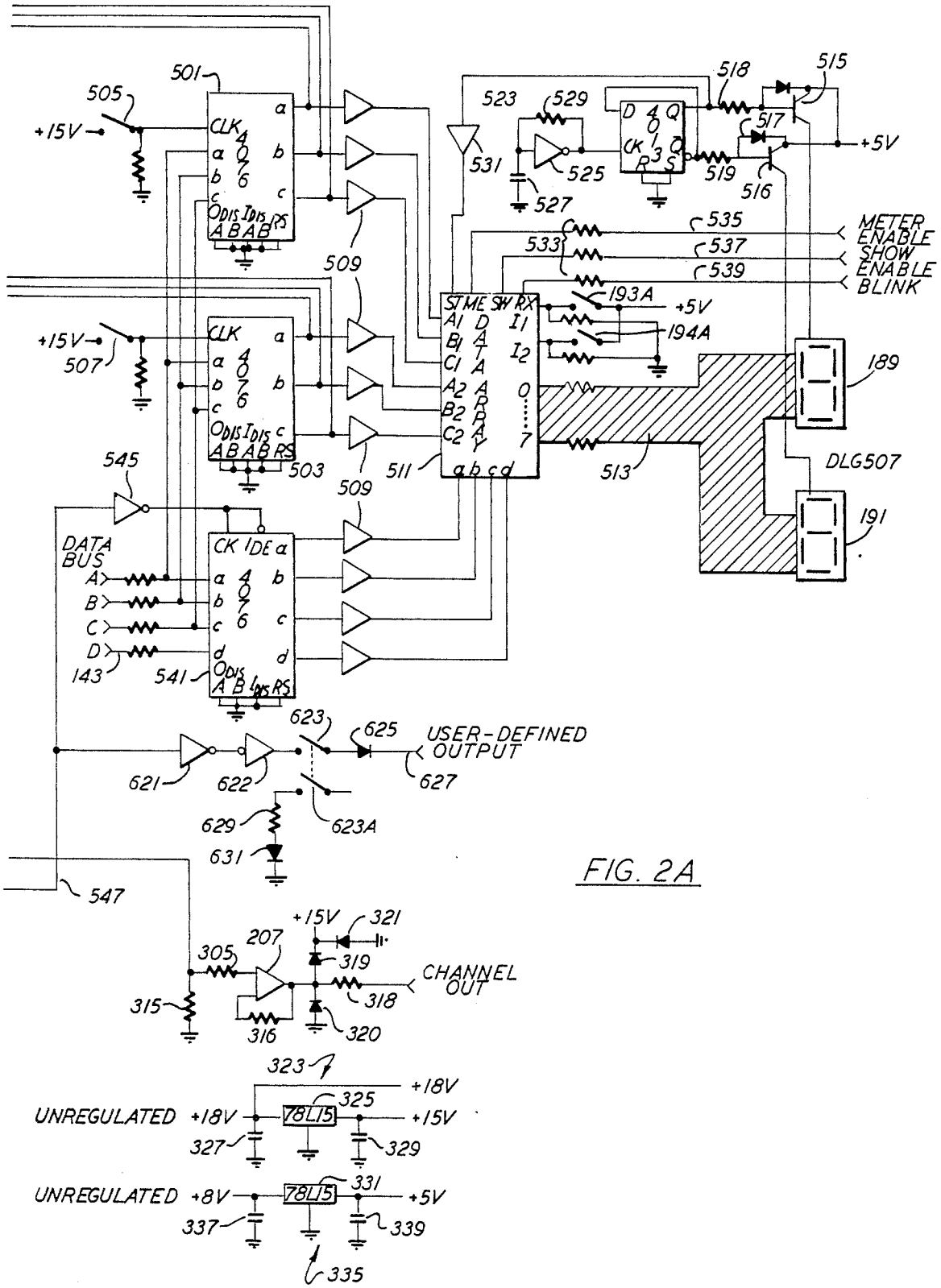
FIGS. 2A and 2B are a detailed schematic-block diagram of a single channel in the console of the present invention.
Figure 2B:
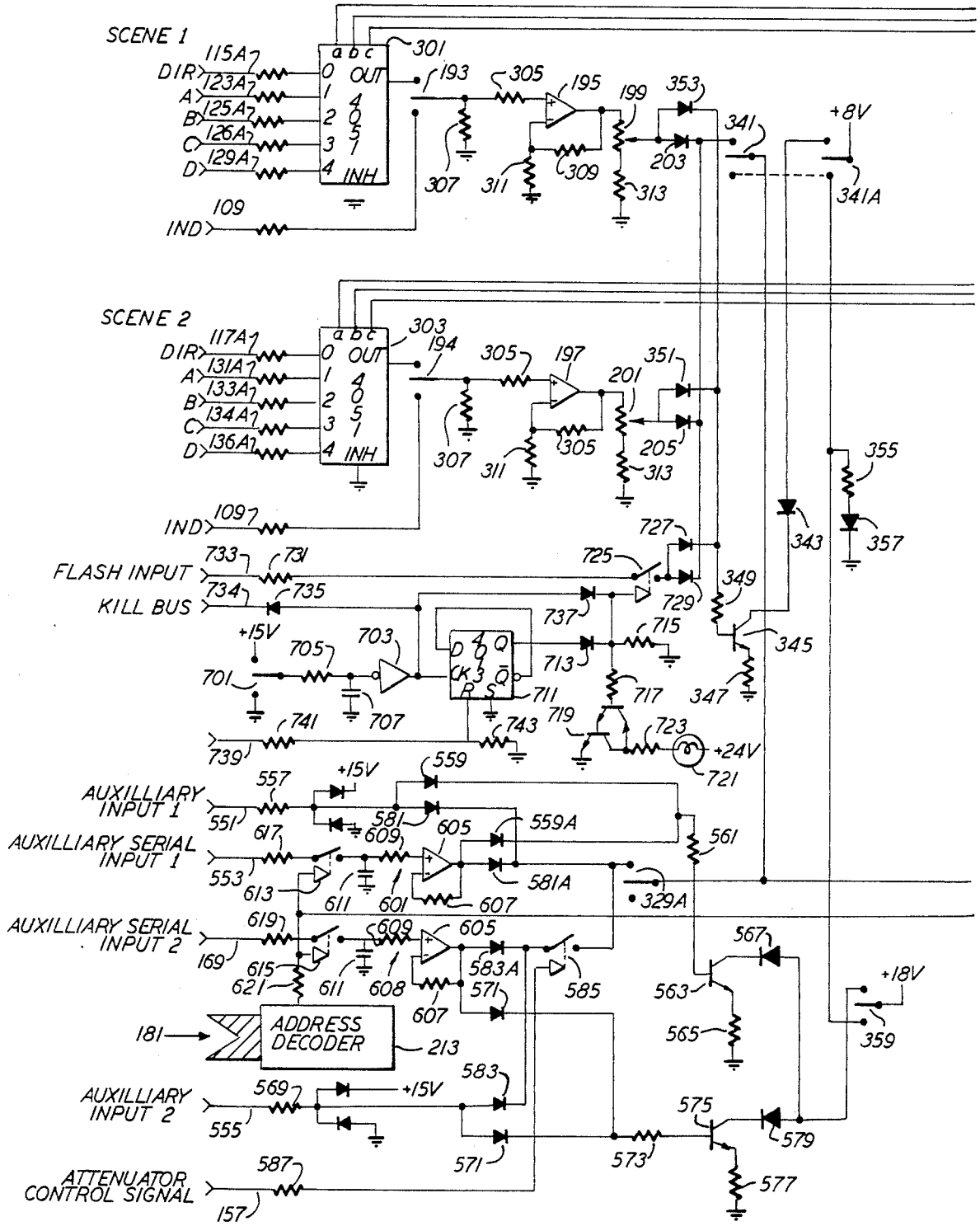

In FIGS. 2A and 2B, which is a more detailed logic/-schematic diagram of the channel electronics, the parts which are the same as those of FIG. 1B will be given the same reference numerals. The input previously described from the master controls including, for example, the independent input on line 109, the direct input on lines 115*a* and 117*a*, and the various submaster inputs are as before, with the exception that there are additional submaster inputs possible on lines 126*a*, 128*a*, 134*a* and 136*a*. These lines are inputs through input resistors, typically of 10K to analog switch modules 301 and 303, one switch being provided for each input. These correspond to the switches 171 and 173 of FIG. 1B. The output of the switch modules is coupled into the switches 193 and 194 which permit switching between the analog switch module outputs and the independent input. The respective outputs from switches 193 and 194 are coupled into the amplifiers 195 and 197. Each is coupled through an input resistor 305, typically 2.2K, with a resistor 307 provided to the ground, typically 100K. Each amplifier has negative feedback from its output to its inverting input through a feedback resistor 309, typically 10K, with a resistor to ground from the inverting input, typically 100K. Potentiometers 199 and 201 are typically 10K pots with an additional resistor 313 at the end of each coupling it to ground. These additional resistors have a low value, for example, of 390 ohms. The output amplifier 207 also has an input resistor 305, typically 2.2K, with a resistor 315 to ground, typically 200K. It has a feedback resistor 316, typically 2.2K. The output is coupled through a resistor 318, typically 10 ohms.

The junction between diodes 319 and 321 is coupled to +15 volts from a separate power supply 323 which includes a regulator 325, typically a 78L15 with capacitors 327 and 329 on each side in conventional fashion. This regulates the unregulated 18 volts to +15 volts. Similarly, a regulator 331 in a power supply 335 regulates 8 volts to +5 volts. Again capacitors 337 and 339 are provided. Amplifiers 195 and 197 which may be a dual operational amplifier pack are supplied from the regulated +15 voltage, i.e. they operate across +15 volts and ground. Similarly, the amplifier 207 is coupled across the regulated 15 volt supply and ground.

The input to the amplifier 207 from amplifiers 195 and 197, is through diodes 203 and 205. These inputs are coupled through a switch 341 designated a channel-kill switch. Channel-kill switch has another pole coupled through an LED 343 to the collector of a transistor 345 with an emitter resistor 347 to ground and a base resistor 349 which is coupled through diodes 351 and 353 to the outputs of the potentiometers 199 and 201 respectively. The movable contact of a second pole 341*a* of switch 341 is coupled to the 18 volt supply and thus provides power to the LED 343 which will be turned on so long as the channel-kill switch is not in the kill position and there is some output from one of the two scenes to turn on transistor 345. When switch 341*a* is in the kill position, the 18 volts is supplied through a resistor 355 to another LED 357 to indicate that position. LED 357 will also be lit if a switch 359 having its movable contact coupled to +18 volts is in a position indicating an auxiliary kill condition. The function of the auxiliary kill switch will be described in more detail below.

Which of the switches of the analog switch modules 301 and 303 are operated is determined by latch circuits 501 and 503. These latch circuits receive inputs from data bus 143. Each has three inputs labelled a, b, c. Similarly, there are outputs a, b and c coupled back respectively to the analog switch modules 301 and 303. Each of the latches 501 and 503 also has a clock input coupled respectively to an assign I switch 505 and an assign II switch 507. Pressing the assign I or assign II switches will cause the latch to set with whatever data is on the data bus 143 and continue supplying that data to the analog switches 301 or 303 until a change is made.

The outputs on lines a, b and c of each of the two latches 501 and 503 are also coupled through buffer amplifiers 509 to a field programmable logic array 511 which provides a plurality of seven-segment outputs utilized to drive LED displays 189 and 191. Only a single seven-segment output bus 513 coupled through resistors, typically 180 ohms, to the seven-segment displays is provided. The common input to each of the displays is supplied by a transistor, display 189 being supplied from transistor 515 and display 191 from transistor 516. Transistors 515 and 516 have their emitters coupled to the +5 volt supply. Each has a diode 517 between its base and emitter. The base of transistor 515 is coupled through a resistor 518 typically 7.5K to the Q input of a D-type flip-flop. Similarly, the base input of transistor 516 is coupled through an input resistor 519 to the $\overline{Q}$ output of D-type flip-flop 521. The D input of flip-flop 521 is coupled to its $\overline{Q}$ output and its clock input is coupled to an oscillator 523 comprising an amplifier 525 with a capacitor 527 coupled to its input terminal and a feedback resistor 529. The RC time constant of the capacitor 527 and resistor 529 which are respectively 0.05 microfarad and 100K ohms establish the frequency of oscillation. This frequency is chosen high enough so that the flicker in the displays 189 and 191 will not be perceptible to the eye. Thus, the output of the latches, in addition to being provided to the switches 301 and 303, is displayed on displays 189 and 191.

The logic array 511 has additional inputs. The Q output of flip-flop 521 is coupled through a buffer amplifier or inverter 531 to an input of the logic. This is necessary in order that as the two displays are switched by the transistors 515 and 516, the proper seven-segment data for the selected display is being provided at the output. In addition, there are three inputs each through a resistor 533 which carry out various control functions. These inputs are respectively what is called "meter enable" input on line 535, a "show" input on line 537 and a "blink" input on line 539. A clock signal for example at 1 Hz is provided on this input, line 539. In addition, the second pole of the individual switches 193 and 194 indicated respectively as 193*a* and 194*a* which couple 5 volts into the logic array 511 are also provided. Thus, when "independent" is selected an indication of this is provided as an input to the custom logic array.

An additional latch 541 is provided for storing and displaying additional data. For example, the data bus can be encoded to indicate a signal level which can be latched into latch 541 in response to a signal on line 543 from an inverter 545, the inverter being driven by input called "select" on line 547. This input is the output of the address decoder 213. When the "meter enable" signal is provided on line 535, rather than displaying the selected information, the value stored in the latch 541 will be provided.

In addition to the scene I and scene II controls, the embodiment of FIG. 2 also permits control by an auxiliary input on line 551, there being parallel inputs to each unit, a serial or addressed auxiliary input similar to what was shown on line 169 of FIG. 1B, and similarly a scene III parallel inputs on line 555 and a scene III serial input on line 169. In addition, there is the attenuation control input on line 157.

The auxiliary input on line 551 is coupled through an input resistor 557, typically a 1K resistor, and through a diode 559 and resistor 561, typically 15K, to the base of the transistor 563 having a resistor coupling its emitter to ground. Coupled in its collector path is an LED 567 having its anode coupled to the auxiliary kill switch 359. If the auxiliary kill switch is not in the kill position, and if there is a signal through diode 559, LED 567 will light. Similarly, the signal on line 555 is coupled through an input resistor 569, typically 1K, and a diode 571 and resistor 573 to the base of the transistor 575 similarly having a resistor, typically 1K, 577 coupling its emitter to ground with an LED 579 in its collector path also coupled to the auxiliary kill switch 359. Thus, if there is a signal on line 555, and if the auxiliary kill switch is not in the kill position, this LED will light. The signals on line 551 is also coupled through a diode 581 and another pole **359*a* of the auxiliary kill switch to the input resistor 305 of the output amplifier 207. Similarly, the input on line 555 is coupled through diode 583 and a switch 585 to auxiliary kill switch 359, thence to the output amplifier. Switch 585 is controlled by the signal line 157 through an input resistor 587 typically 10K. Switch 585** is an analog switch and is used for pulse width modulation of the incoming signal thereby attenuating the signal in the manner disclosed in the aforementioned U.S. Pat. No. 3,946,273.

When signals are provided on line 555 and 551 from a memory board or the like, a separate line is required for each channel. However it is also desirable to provide different levels to different channels on a single line. This is accomplished by means of sample and hold circuits 601 and 603 respectively, each sample and hold circuit includes an amplifier 605 having a negative feedback resistor 607 and an input resistor 609 with a capacitor 611 to grcund at the input to the input resistor 609. Each also includes an analog switch as its sample switch. Thus, there is shown a switch 613 for the sample and hold 601 and a switch 615 for the sample and hold 603. Switch 613 is coupled to line 553 through an input resistor 617, typically a 1K resistor. Similarly, switch 615 is coupled to line 69 through an input resistor 619, also typically 1K. the control input for the analog switches 613 and 615 is provided from the output of the address decoder 213 through an input resistor 621, typically 10K. With a signal on line 553 or line 163, when the address of the particular channel is detected by its address decoder, an output on line 547 occurs, closing the switches 613 and 615 and causing them to sample whatever is on line 553 and/or line 169. The switch then opens and that value remains stored. The outputs of the sample and hold circuits 601 and 603 are coupled in the same manner as the signals on lines 551 and 553. Thus, associated with the auxiliary sample and hold circuit 601 is a diode **559*a* coupling into the auxiliary LED indicator and a diode 581*a* coupling through the auxiliary kill switch 359*a* to the output. Similarly, diode 583*a* couples into the modulating switch 585 and diode 571*a* couples into the modulating switch 585 and diode 571*a* couples into the transistor 575 controlling LED 579**.

The select output on line 547 is also coupled through a pair of inverters 621 and 622, a switch 623 having auxiliary contact **623*a* and a diode 625 to what is called the "user defined output" on line 627. This is a common bus shared by all channels and permits providing feedback information through the closure of switch 623. The auxiliary contact 623*a* is coupled to 18 volts and when closed couples the 18 volts through a resistor 629, typically 15K, to light an LED 631** indicating that it is closed.

Although the present embodiment is for a hardware device, it should be clear that many of the functions can also be performed with microprocessor. The present embodiment is also shown with level information distributed in serial analog form, although it will be clear that with the appropriate components, this information could be accepted, processed, and produced in digital form. Further, while the present embodiment shows the mode selected for a channel potentiometer stored at the module; it is clear that the mode selection could be recorded on a data carrier at a central location by either sampling the outputs of the channel latches or by deriving notice of assign switch closure by a method similar to the "user defined switch" 623 to create a duplicate record. This data carrier would allow the operator to recreate the control assignments for a given production by reading back the carrier into the console. Finally, it will be apparent that, when manufacturing volume permits, it will be desirable to replace the current, separate assign switches 505 and 507 with a mechanical, pressure, or capacitive switch integral with the window covering the displays in order to reduce panel area requirements and further improve operability.

Associated with each channel is what is called a flash or bump button 701. This is a switch capable of coupling either +15 volts or ground through an inverter 703 having a resistor 705, typically 10K, at its input with a capacitor 707, typically 0.01 F to ground. The output of the inverter 703 is the clock input to a D-type flip-flop 711. The $\overline{Q}$ output of flip-flop 711 is tied back to its D input. This means that absent any other signals, as it is clocked, it will change state at the clock rate. The Q output is coupled through a diode 713 to the junction of a resistor 715 and a base resistor 717 for a Darlington pair 719. Resistor 715 has its other end tied to ground. Typically resistor 715 is 100K and resistor 717 is 15K. Resistor 717 couples the output of the flip-flop 711 into Darlington pair 719 which drives an incandescent lamp 721 coupled to +24 volts, a current limiting resistor 723 also being provided in the path. The output at D-type flip-flop 711 is also an input to an analog switch 725, the output of which is coupled through diodes 727 and 729 to the transistor 345 for the channel LED and the channel kill switch 341 respectively. In addition, through diode 737, switch 701 directly drives switch 725 and Darlington pair 719. Switch 725 receives an input through an input resistor 731 from an input on line 733 designated the flash input. The flash input is a level to which the channel will be brought when the bump button is pressed to cause the circuit comprising inverter 703, resistor 705 and capacitor 707 to provide a debounced input to flip-flop 711 and directly to switch 725. The channel output will then receive a signal at the level of the flash input 733. Three possible modes of operation are possible. These are "kill"; "momentary" and "alternate." By pressing switch on and off with flip-flop 711 held reset by a signal on an input line 739 B through resistor 741, typically 10K, with a resistor 743, typically 100K, to ground, flashing is accomplished at the rate at which the switch is operated. In addition, there is a kill bus which is coupled through a diode 735 to the output of the inverter 703. This output can be used in the master section to "kill" all other channels but the one whose switch 701 is pressed, for example. When a reset signal is not present on line 739, alternate operation takes place. Each time switch 701 is pressed, flip-flop 711 changes state.

Figure 3:
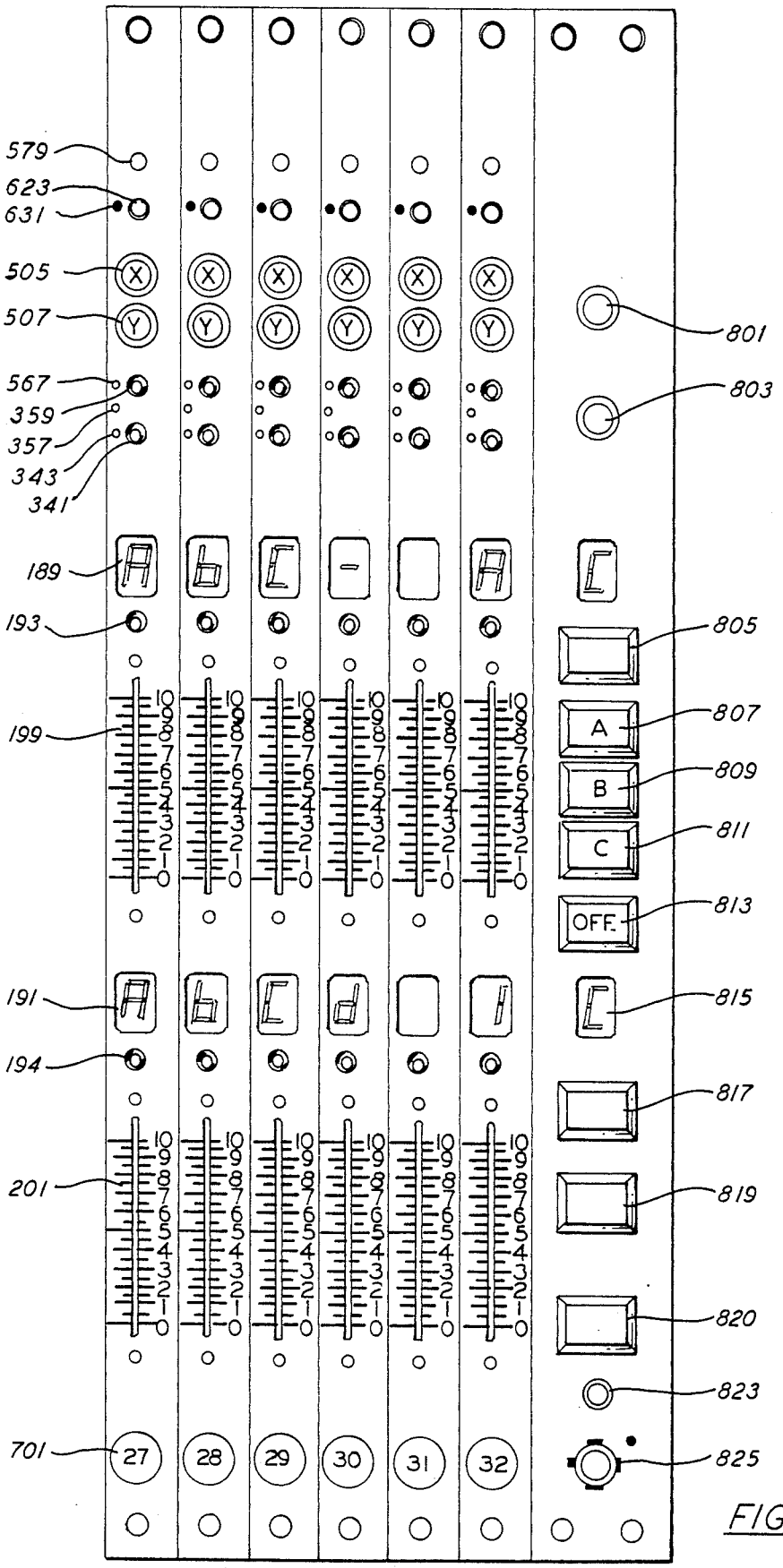
FIG. 3 is a plan view of a portion of the console of the present invention.
Figure 3A:
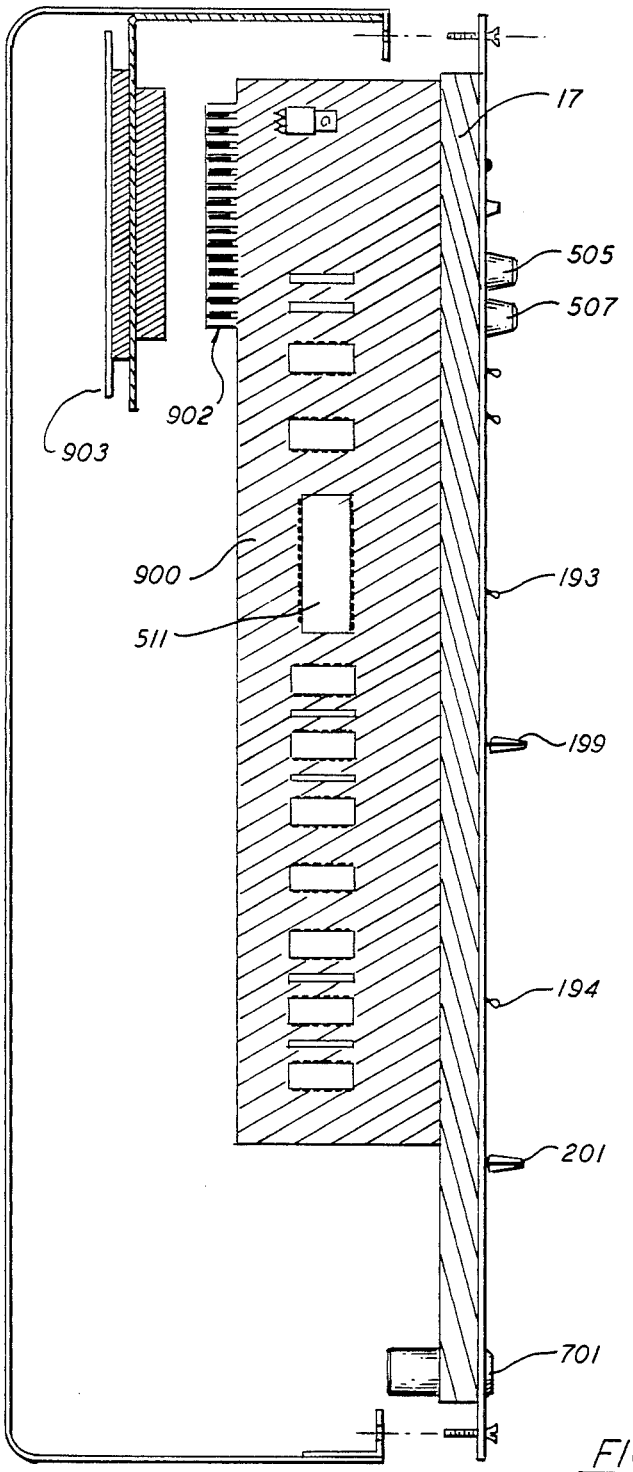
FIG. 3A is a side view of a portion of the console.

FIG. 3 is a plan view helpful in conjunction with FIG. 2 in understanding operation of the system. Shown are a plurality of strip modules 17, each containing all the circuits shown in FIG. 2. This modular construction adds flexibility to the system, permitting construction of the system with as many or as few channels as is desired. As illustrated by FIG. 3A, each module 17 has a board 900 with an edge connector 902. This plugs into a connector on a board 903 which is coupled to the master control and supplies all the signals shown as inputs to FIG. 2. The various controls discussed in connection with FIG. 2 are shown in FIG. 3. Thus, the preset potentiometers 199 and 201 which are typically sliding potentiometers for presetting scene I and scene II for the particular channel are shown. Also shown are the LED displays 189 and 191. The flash button, also referred to as the "bump" button, or switch 701 of FIG. 2 is also shown. The independent switches 193 and 194 are shown located directly below their respective seven-segment LED displays 189 and 191.

LED 579 indicating that a scene III input is present is visible at the top of the figure. LED 343 indicating a channel signal is present is located next to the channel kill switch 341. Similarly, the auxiliary LED 567 is located next to the auxiliary kill switch 359. The kill LED 357 is located between the two.

Also shown in FIG. 3 are some of the master controls. Shown are potentiometer controls 801 and 803 for controlling the voltage supplied respectively to the bump buttons 701, more particularly their lamps 721 seen in FIG. 3, and supplied to the various displays to control their brightness. Also shown are a series of push button switches corresponding generally to the switches 137, 139 and 141 of FIG. 1A. These switches include a direct switch 805, submaster A 807, submaster B 809, submaster C 811, and an off switch 813. These switches are electronically interlocked. The one of the switches selected is indicated on an LED display 815 and a corresponding output is provided on bus 143. In addition, there is a "show me" switch 817. This provides the output on line 537 of FIG. 2. There is a "show me level" switch 820 which corresponds to the meter enable line 535 of FIG. 2. There is a "show me independent" switch which also provides an output on 537 and also puts on bus 143 the address corresponding to independent. Finally, there are a pair of controls 823 and 825 which permit providing the various inputs flash, kill, and flash RS-modes on lines 733, 734 and 739 of FIG. 2 to control operation of the bump button 701.

In operation, when it is desired to set up the console, the operator presses one of the buttons 805, 807, 809 or 811. Pressing this button puts a corresponding output on the bus 143 which is provided to all of the three latches 501, 503 and 541 of FIG. 2. If a channel is to be assigned to that submaster, then the assign switch 505 or 507 for that channel is pressed storing that information in the associated latch and thereby controlling the analog switch. Once all the channels to be set up for direct are assigned by pressing their assign buttons 505 and/or 507, the next submaster is set in, for example A, and the process repeated for that, and then for B and C. At each of the channels, the potentiometers 199 and 201 are preset. The control assignment selected will appear on the respective display 189 or 191. When all selections have been made, one can press one of the buttons 805, 807, 809 and 811 and then press the "show me" button 817. This provides an input on the line 537 and causes the displays for all channels not assigned to the selected mode to go out. Those normally assigned to the selected mode but presently in independent will flash. Thus, if, as indicated on the LED display 815, submaster C is selected, all of the displays would go out except those which had selected C.

By throwing independent switch 193 or 194 it is possible to select independent rather than one of the submasters or the direct master control. Pushing the "show independent" will cause all of the channels except those assigned to independent to go out. Finally, pressing the "show me level" switch will cause the information latched in latch 541 to be displayed on the LED to show a level, for example, a level associated with scene III. Note that latch 541 is latched by a clock input from decoder 213. Thus, each channel can store separate level information in this latch.

Pushing one of the bump buttons 701 will cause the associated channel to be brought up immediately to the level set in on the flash bus 733. If there is no input on line 739, pressing the flash button will clock the flip-flop on causing it to latch and close the switch if the switch was off. It will, at the same time, feed this signal back through diode 735. The purpose of this, if "kill" is selected at the master section, is to kill all other channels.

Fault Isolation

As noted above, one of the important aspects of the system of the present invention is in the fault isolation which it provides. To understand the improvements in the fault isolation obtainable in accordance with the present invention, a typical prior art arrangement has been illustrated in FIG. 4. The illustrated embodiment is one in which there are two scenes with two master or submasters for each scene. However, in the simplest type of board, one would simply have a single scene master control, for example, master control 101. In the illustrated embodiment, this comprises a potentiometer 103, the output of which is amplified by an amplifier 105 receiving power from a power source 107. The output of amplifier 105 is placed on a bus 109 and feeds a set of potentiometers, one being provided for each channel, i.e. each light or group of lights. The simplest arrangement in the prior art consists of a potentiometer 111 coupled between this bus and ground the wiper of which provides an output on line 113 to a dimmer for that channel. The dimmer will be driven by the DC voltage produced at the master 101 attenuated by the setting of the channel potentiometer 111. Thus, the simplest type of system would consist of a master control 101 providing an output to a bus 109 with a plurality of potentiometers such as 111 providing outputs for the different channels.

However, in the illustrated embodiment, there is the possibility of an additional scene. Thus, there is also provided a potentiometer 103*a* providing its output to an amplifier 105*a*, this constituting another master control 101*a*. The output is provided to a bus 109*a*. Bus 109*a* through a switch 115*a*, to be described below, feeds a channel potentiometer 111*a* which has its other end connected to ground. In this case the wiper of the potentiometer provides an output line 113*a* which is coupled through a diode 117*a* to the final output on line 113*c*. Similarly, coupled to line 109*c* is a potentiometer 111*b* providing its output on line 113*b* through a diode 117*b* to the final output 113*c*. As indicated, the illustrated embodiment provides the possibility of two masters for each scene and thus there is also shown a master control 101*b* comprising potentiometer 103*b* and amplifier 105*b* associated with scene I, and another master 101*c* comprising potentiometer 103*c* and amplifier 105*c* associated with the scene II master. Switch 115*a* and a similar switch 115*b* permit selecting between one or the other of the scene I and scene II masters.

Figure 4:
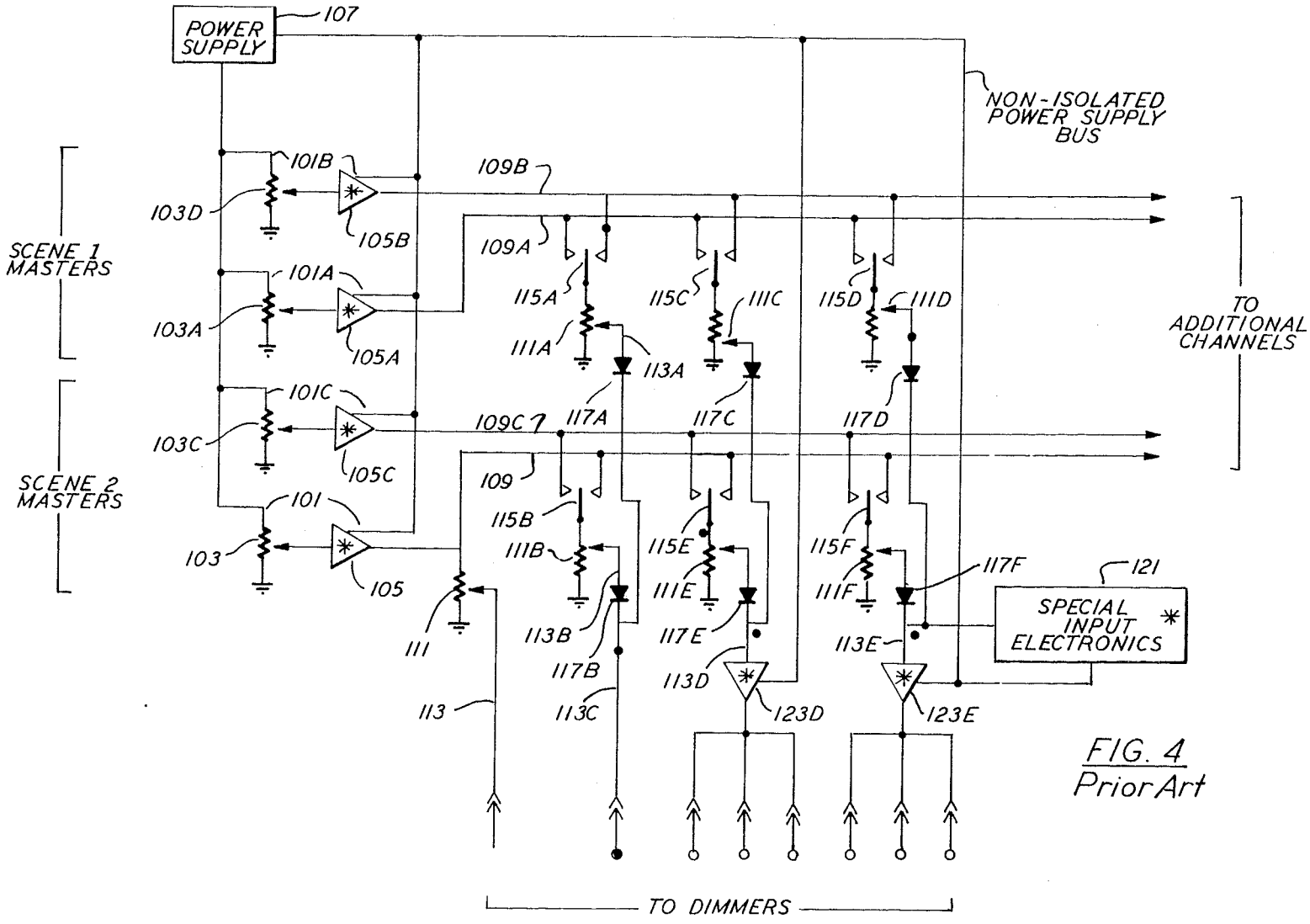
FIG. 4 Prior Art
FIG. 4 is a schematic diagram illustrating a typical prior art arrangement in consoles of this nature.

Also shown in FIG. 4 are additional controls for two more channels including switches 115*c*, 115*d*, 115*e* and 115*f*, potentiometers 111*c–f*, and diodes 117*c–f*. Also shown associated with the output 113*e* of the last channel are special input electronics 121. These combine special features having channel outputs through isolating diodes with the output of the two scene potentiometers. They can be the auxiliary or scene III inputs of FIG. 2. The last two channels having outputs on lines 113*d* and 113*e* are shown as having buffer amplifiers 123*d* and 123*e* associated therewith and each is shown as driving plurality of dimmers.

In the illustrated embodiment all of the amplifiers 105 and 105*a–c* and amplifiers 123*d* and 123*e* are fed from the same power supply 107. An examination of FIG. 4 should make it clear that the loss of one of the amplifiers 105*a–c* will result in the complete loss of that function to all channels. However, there are many kinds of faults, particularly short circuits in the channel level wiring attached to the buses 109 and 109*a–c* which can alter the load characteristics of the bus causing the amplifier to either temporarily disable due to current limiting or become permanently damaged. This can either result from faults in the switches 115*a–*115*f* in the potentiometers 111*a–f*, or wiring after the potentiometer when it is set at a high enough level to make the fault visible enough to the bus. Thus, there are shown on the drawing a number of black dots. Short circuits at these points can disable large parts of the console. These include a short at the output of the switch as shown by switch 115*a*, on the line leading to the switch as shown in connection with switch 115*b*, in the switch contact as shown by potentiometer 111*d*, which is set so high that there is very little resistance between the wiper and the amplifiers. Also, at the output of diode 117*f* the potentiometer of 111*f* of which is also at a high level a short can cause the massive failure. Also shown in connection with line 113*c* are two more black dots indicating that at either side of the connector leading to the dimmer a short circuit through diode 117*b* and potentiometer 111*b* can cause failure at the amplifier.

Other points on the diagram are shown by asterisks. These are essentially the amplifiers 105, 105*a–c*, 123*d* and 123*e*. Failure of these parts can also disable or cause failure in other sections of the console. For example, they can cause the power supply to current limit, thus affecting not only their own channel but other channels as well.

Thus, the present state of the art consoles are subject to serious failures which may be difficult to troubleshoot.

Figure 5:
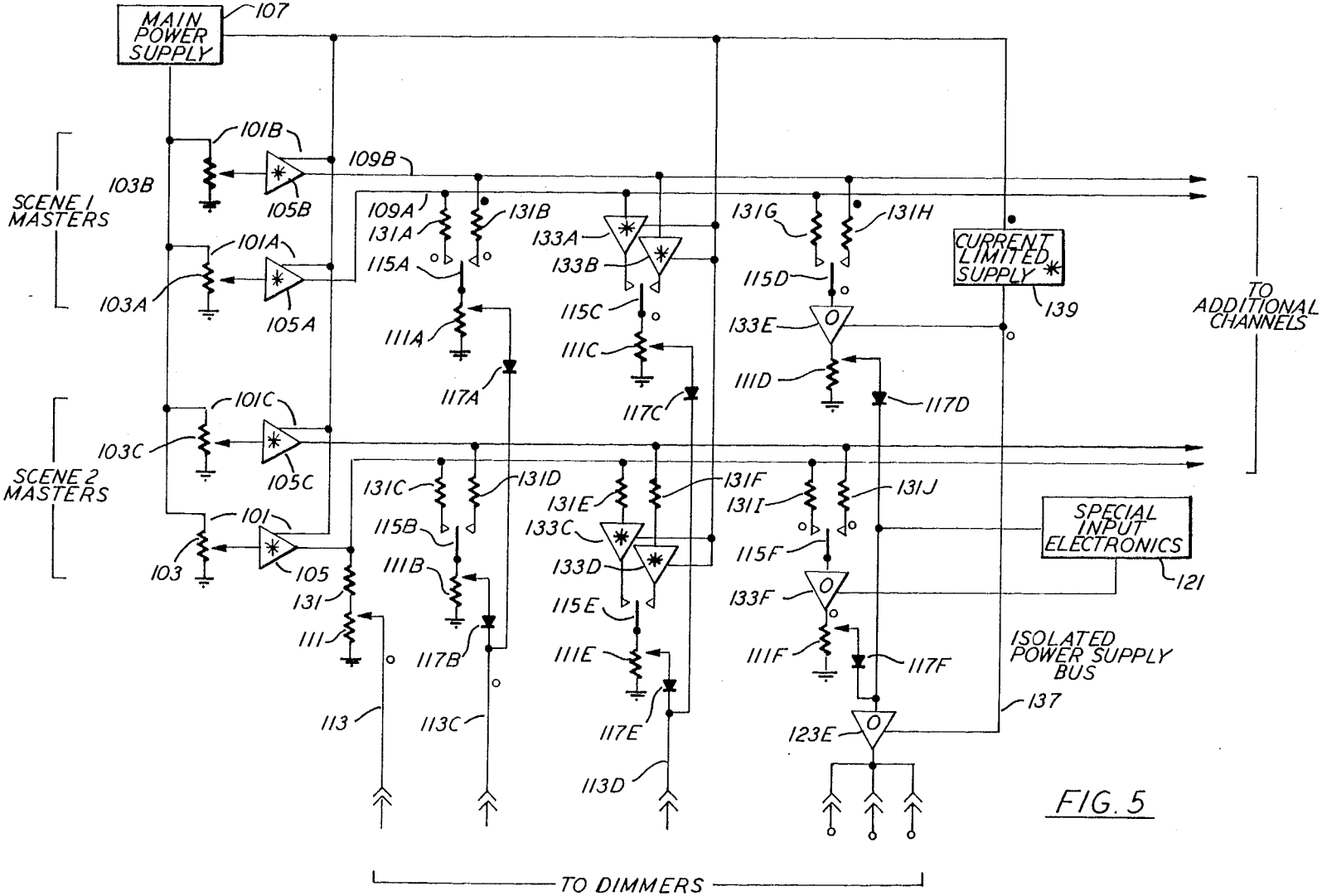
FIG. 5 is a similar drawing illustrating the manner in which fault isolation is achieved by the present invention.

FIG. 5 illustrates the manner in which the present invention minimizes the effect of the faults. In this drawing, parts which are the same as those in FIG. 4 have been given the same reference numerals. In general, the present invention accomplishes fault isolation by means of three measures. The simplest of these is illustrated in connection with potentiometer 111. In series with the potentiometer a resistor 131 is provided Now, even with the potentiometer at its highest position, a short at line 113 will not result in a failure at amplifier 105. The value of resistor 131 must be very much lower than the impedance of the channel potentiometer. The master amplifier 105 must be capable of delivering a current which equals the normal operating current of the channel control times the number of channels plus allowance for the current draw of a faulted channel as limited by the resistor 131, times a number of channels to take into account plural faults. A failure occurring for example on the line 113 can be easily isolated and will be localized.

This same scheme is shown in connection with the potentiometers 111*a* and 111*b* in which case separate resistors 131*a* and *b* and 131*c* and *d* are provided. Because of this isolation, only if a fault actually occurs at the bus itself or on the side of the resistor connected to the bus will the failure propagate back to the master amplifier.

Although this arrangement can be used in many cases, the arrangement illustrated with the potentiometers 111*c* or 111*e* is preferred. In this case, buffer amplifiers 133*a* through 133*d* are provided. Buffer amplifiers 133*a* and *b* are connected directly to the buses 109*b* and 109*a*. The amplifiers 133*c* and 133*d* are connected through resistors 131*e* and 131*f*. The amplifiers provide additional isolation and furthermore relieve the power requirements on the master amplifier. The master amplifier need no longer drive all of the channel potentiometers. As a result a smaller, simpler, and less expensive and more reliable master amplifier can be used decreasing the chance of failure. Furthermore, added flexibility is provided with this design in that channels can be added afterwards since the master amplifier will still be capable of supplying additional channels each of which will have a high impedance amplifier at their input. In this arrangement, the power supply bus. The arrangement associated with potentiometers 111*d* and 111*f* avoids this. In these embodiments, the inputs to the switches 115*d* and 115*f* are coupled through resistors 131*g* through 131*j*. The outputs of the switches 113*d* and 113*f* are inputs to amplifiers 133*e* and 133*f* respectively. In this embodiment, the amplifiers rather than being supplied directly from the power supply bus are supplied from an isolated power supply bus 137 which in turn is supplied by a current limited supply 139. This may be simply a solid state voltage regulator with appropriate filtering capacitors. Now, a failure of amplifiers 133*e* and 133*f* will only affect their channel and will not propagate back to the power supply bus to affect the whole console. In FIG. 5, the same convention with respect to massive failures is indicated by a black dot and failure in amplifiers which may spread is indicated by an asterisk. A local failure in amplifier which will not spread is indicated by an open square, and a local failure otherwise by an open circle. With the last embodiment illustrated, it is apparent that the only failures which will be of a massive nature are those which occur on the buses. Any failures past the resistors 131*g* and *h* for example will be local in nature. Thus, in summary, the present invention takes three steps, alone or in combination, to achieve fault isolation. The first step is to provide isolating current limiting resistors such as resistor 31. The second step is to provide buffer amplifiers either alone or in addition to such resistors. The third step is to supply the buffer amplifers in a given channel from a separate current limited supply.

The channel illustrated in FIG. 2 incorporates all of these features. It has separate supplies for supplying both 5 and 15 volts, includes buffer amplifiers at the output of the master selector, these amplifiers having input resistors which assure further current limiting back to the master. In addition, it is noted that the unit illustrated by FIG. 2 is not only electrically but mechanically isolated, in the design of the present invention, which, of course, adds to the flexibility of the present system in providing from basic building blocks as many channels as are needed for a particular application.

With respect to separate current limited supplies and the other techniques just noted, although illustrated for a single channel, for reasons of economy these measures can be taken for groups of channels. Of course, the isolation will not be as good but it will still be superior to that provided in the present day state of the art equipment.

Encoding and Decoding

Figure 6:
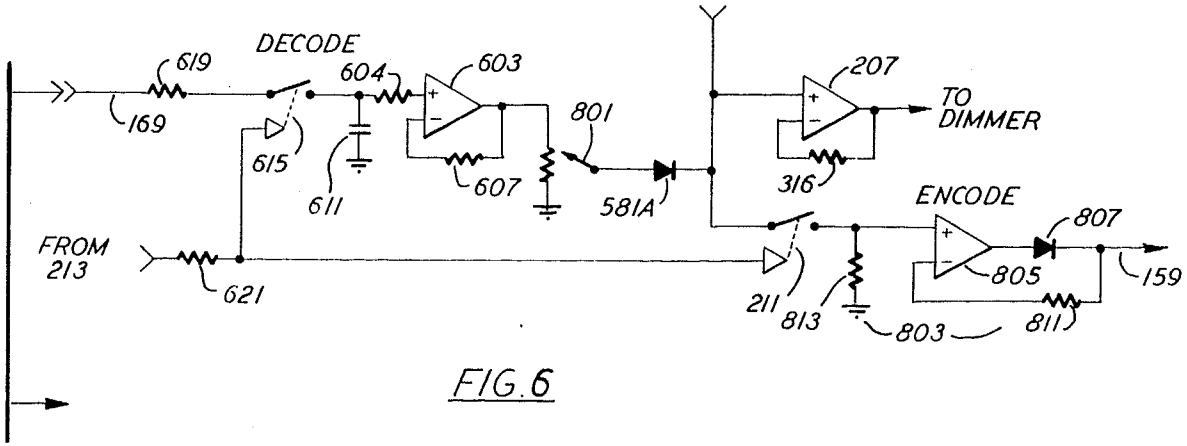
FIG. 6 is a diagram showing the manner in which encoding and decoding of levels is done in a channel.

FIG. 6 shows a portion of the sample and hold circuit 603 of FIG. 2 and shows how, utilizing a precision half wave rectifier 803 one can, in addition to decoding, encode and output back to the memory board, for example. The encoder follows the switch 211 shown in FIG. 1B. Upon an input from address decoder 213 through resistor 621, switch 211 is closed. Whatever voltage is present at the input to the output amplifier 207 is also provided as an input to the encoding circuit which includes an amplifier 805 having in its output coupled through a positively poled diode 807, the output of which is coupled through a feedback resistor 811 to the inverting input of the amplifier. The non-inverting input of the amplifier which receives the input through the switch is coupled to ground through a resistor 813. This is a circuit well known for use, a precision halfwave rectifier. It is used here because it combines the effects of diode isolation with the current capability of a buffer. The output of this circuit on line 159 is fed to a bus shared by all channels. Although in this embodiment, both the decoding and encoding are enabled by the same output of the address decoder, it will be recognized that separate decoding and encoding enable pulses could be developed to separately drive switches 211 and 615.

Figure 7:
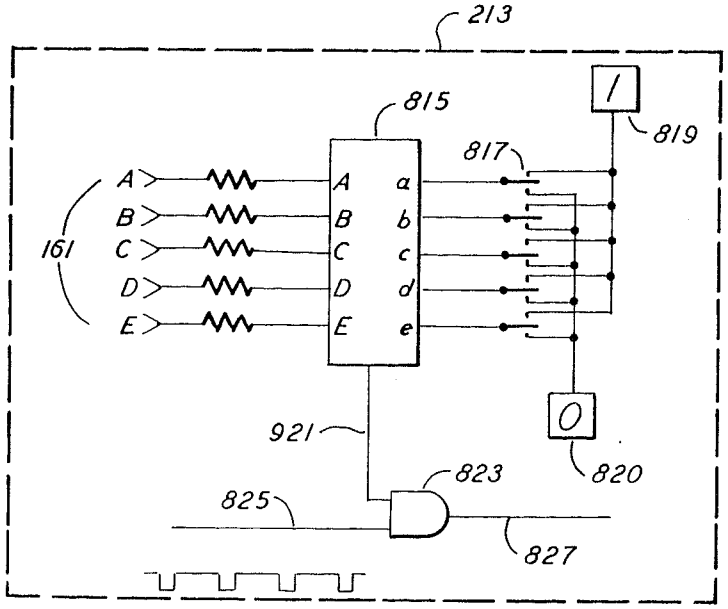
FIG. 7 illustrates a first embodiment of address decoder of the present invention.

FIG. 7 shows an example of a local address decoder. Inputs on bus 161 are coupled through fault isolating resistors to a binary decoder 815. This decoder which may simply comprise a series of gates receives inputs from a set of switches 817 which permit setting each of the inputs to either a "0" or a "1" indicated by inputs 819 and 820. When the address on the bus 116 matches that set in on the switches 817, there is coincidence and an output is developed on line 821. This is one input to an AND gate 823 which receives a clock input on line 825. The output of gate 823, 827 controls the switches 613 and 615 of FIG. 2 for example.

Figure 8:
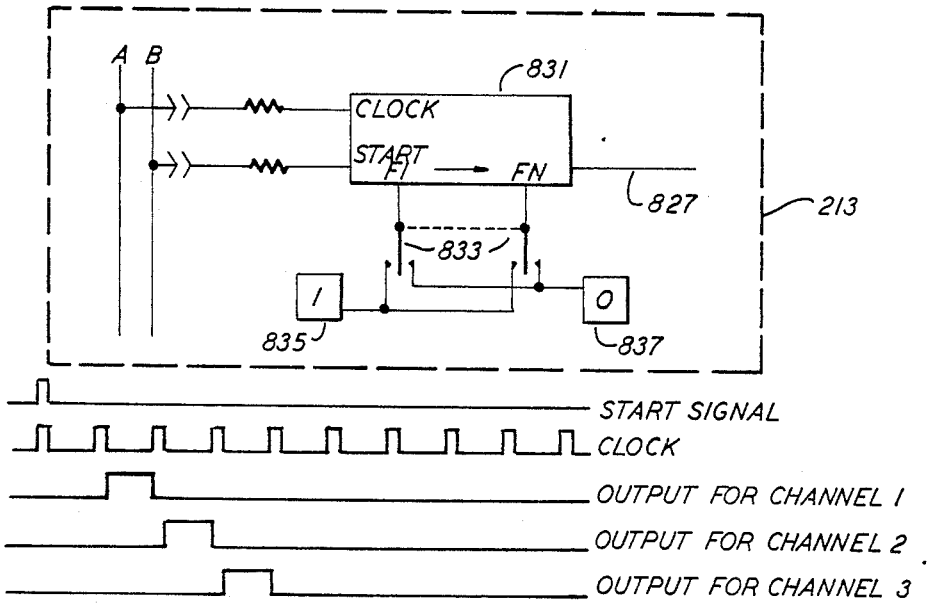
FIGS. 8 and 8A illustrate a second embodiment of address decoder according to the present invention.

Another embodiment is shown by FIG. 8. In this device only two inputs are required, i.e., the bus 161 need only have two lines. Line B contains a start signal and line A a clock signal. These are inputs through input resistors to a clock and start input of a programmable delay unit. Programmable delay unit 831 has set into it, through a series of switches 833 which can be set to either a 1 input 835 or a 0 input 837, a desired delay. After receipt of the start pulse, the programmable delay unit counts a number of clock pulses specified by the programming inputs f-l through f-n set in by switches 833. When the number of clock periods counted equals the number set in the programming input, an output will appear on line 827. It remains in this state for no more than one clock period. The unit then remains inactive until another start pulse is received. The output on line 827 however will close the switches associated with the sample and hold circuits 601 and 603 long enough to carry out the necessary sampling. Traces E, F and G illustrate the outputs for three successive channels. The first output occurs after counting one clock pulse past the start signal. The output begins on the falling edge of the clock period and ends on the rising edge. Thus, there is a gap of the length of the clock pulse between that of one channel and the output for the next channel to allow data on the serial information bus to stabilize. These outputs are, of course, each generated by separate local pulse generators which form the decoder 213 of FIG. 1B and FIG. 2.

Figure 8A:
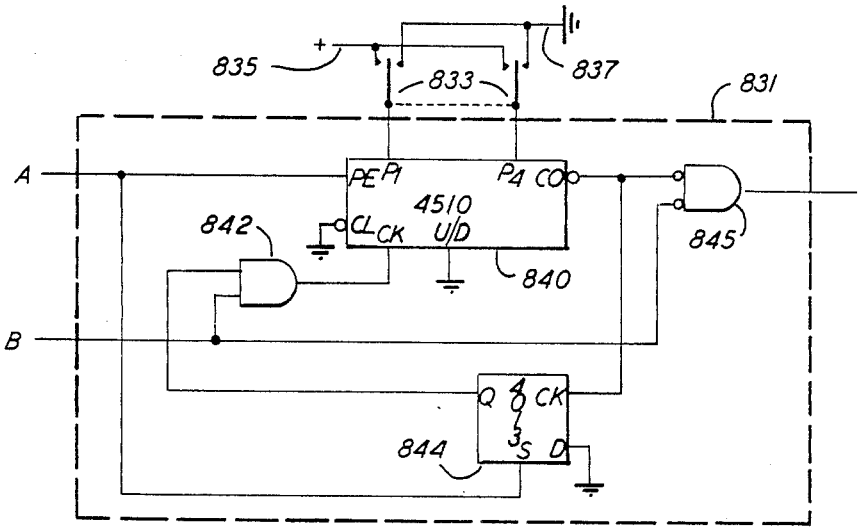

FIG. 8A shows the local pulse generator 831 in more detail. The logic "1" signal is provided by a positive voltage and the logic "0" signal 837 by ground. The inputs of switches 833 are provided as inputs to an up-down counter 840 set to countdown. The B signal is provided as a preset enable signal to the counter presetting it to the value set in on the switches. The clock signal on line A is coupled through an AND gate 842 into the clock input. Gate 842 is enabled by a D-type flip-flop 844. The start signal, in addition to presetting the counter 840 and enabling it, sets the flip-flop 844 so that its Q output becomes a "1" enabling AND gate 842. At this time, the output CO (zero count) is a logic "1" at the inverted output. The next clock pulse will be passed by AND gate 842 and counted in the counter 840. Counting continues until the value set in by switches 833 is counted down to zero. The output CO on the counter will then change state. When the clock pulse goes low, AND gate 846 will, after inversion at its input, have two logic "1" inputs and provide a logic "1" output. On the next clock pulse the count is counted down to all "1s" causing CO to change state and clock the D-type flip-flop. This will cause the "0" on its D input to be transferred to its output. This prevents any further counting by disabling gate 840. At this time the output of gate 846 also goes to logic "0" again. Thus, through this gating there is no overlap between two subsequent pulses.

Finally, with respect to the attenuation of the scene III signal, it is noted that in addition to the pulse width modulation discussed and described in the aforementioned patent, this attenuation can be done with a voltage controlled amplifier or with a digital attenuator, in which case the signal, rather than being on a single line 157, would be obtained from the data bus 143.

What is claimed is:

1. In a lighting console providing outputs to dimming means, said console including:

(a) master controls for at least two scenes; and (b) channel controls for each of a plurality of channels, said channel controls including at least a first and second scene preset potentiometer, said channel controls and said master controls cooperating to allow presetting;

(c) a buss;

(d) one of said preset potentiometers for each of a plurality of channels connected to said buss;

(e) means for driving said buss, said means for driving having an input coupled to one of said master controls, the improvement comprising:

(f) a plurality of nondestructively current-limiting fault isolating means for each scene, each connected between said master, and at least one of said preset potentiometers for said scene whereby the effects of a fault causing abnormal currents to flow which develops after said fault isolating means will not disrupt the operation of channel potentiometers connected to other fault isolating means.

2. The improvement according to claim 1 wherein said fault isolating means comprise resistors.

3. The improvement according to claim 1 wherein said fault isolating means comprise amplifiers, said amplifiers having non-destructively current-limited outputs, and having stable input characteristics.

4. The improvement according to claim 3, and further including resistors coupling the inputs of said fault-isolating amplifiers to said buss, the value of said resistor providing fault isolation, whereby a failure of the fault isolating amplifier will not disrupt the operation of the channels connected to other fault isolating means.

5. The improvement according to claim 3 or claim 4 wherein a power supply distribution buss is provided for supplying power to said fault isolating amplifiers and further including a plurality of current limiting means each connected between the power supply distribution buss and at least one of said fault isolating amplifiers.

6. The improvement according to claim 5, and further including additional active electronic components associated with at least one channel, said active electronic components also supplied by said current limiting means.

7. The improvement according to claim 1, 2, 3, or 4 the improvement further comprising at least one of said fault isolating means and its associated preset potentiometer combined on a common mechanical module.

8. The improvement according to claim 1, wherein a common mechanical module contains all preset potentiometers for a single channel.

9. The improvement according to claim 1, and further including at least one additional signal source producing discrete channel outputs, the output of said first and second potentiometers being combined with said discrete channel output at a combining point, and a further fault-isolating means located between said discrete output of said additional signal source and said combining point.

10. The improvement according to claim 9, wherein said further fault isolating means comprises a resistor.

11. The improvement according to claim 9, wherein said further fault isolating means comprises an amplifier, said amplifier having a non-destructively current-limited output and having stable input characteristics whereby the operation of other channels is not disrupted.

12. The improvement according to claim 11, and further including a resistor coupling the input of said fault-isolating amplifier to said discrete output, the value of said resistor providing fault isolation whereby the failure of the fault isolating amplifier will not disrupt the operation of other channels.

13. In a lighting console providing outputs to dimming means, said console including:

(a) master controls for at least two scenes; and (b) channel controls for each of a plurality of channels, said channel controls including at least a first and second preset potentiometer, said channel controls and said master controls cooperating to allow presetting; and, (c) at least one port for communications with an external control means at another location, said port including at least one active electronic component;

(d) at least one positive power supply producing a voltage within the safe operating region of said active electronic component, and means establishing a more negative reference potential within the safe operating region of said active component, the improvement comprising:

(e) means for protecting said active electronic component against damage caused by relative voltage swings greater than said safe operating region comprising:

(f) a first diode coupled between said port and a low impedance path to said positive power supply:

(g) a second diode coupled between said port and a low impedance path to said reference; and (h) means for current limiting coupled between said diodes and said port, whereby a more positive or more negative voltage imposed on said port will be limited to within the safe operating region of said connected active component.

14. In a lighting console providing outputs to dimming means, said console including:

(a) master controls for at least two scenes; and (b) channel controls for each of a plurality of channels, said channel controls including at least a first and second preset potentiometer each assignable to be responsive to any one of a plurality of said master controls, said channel controls and said master controls cooperating to allow presetting, the improvement comprising:

(c) a plurality of electrically-alterable display devices, each associated with one of said plurality of channels, located in proximity to said first and second preset potentiometers, capable of displaying alpha or numeric symbols within a common display area indicative of the assignment of at least one of said first and second preset potentiometers;

(d) means for storing the master assignment of each of said channel potentiometers;

(e) means for driving said display device coupled to said means for storing.

15. The improvement according to claim 14, wherein said electronic display device comprises a segmented display.

16. In a lighting console providing outputs to dimming means, said console including:

(a) master controls for at least two scenes; and (b) channel controls for each of a plurality of channels, said channel controls including at least a first and second preset potentiometer each assignable to be responsive to any one of a plurality of said master controls, said channel controls and said master controls cooperating to allow presetting;

(c) master selector means for selecting a master assignment;

(d) assignment switches for each of a plurality of preset potentiometers located in proximity to said preset potentiometers for specifying the potentiometers to be assigned to said master selection; and (e) means for storing selected master assignments for said potentiometers coupled to said means for selecting and said means for specifying; the improvement comprising:

(f) a plurality of electrically-alterable display devices each associated with one of said plurality of channels, located in proximity to said potentiometers, capable of displaying alpha or numeric symbols within a common display area indicative of the assignment of at least one of said potentiometers; and (g) means for driving said displays to indicate said selected assignments.

17. The improvement according to claim 16 and further including a precedent assignment to which at least one of said channel potentiometers may be switched, and further including means for switching to said precedent assignment, and means for indicating said precedent assignment on said display.

18. The improvement according to claim 17 and further including means for storing the master assignment selection during the operation of said means for switching, whereby when said precedent condition is deselected, said potentiometer will be returned to said previous assignment.

19. The improvement according to claim 16 and further including means to extinguish said electronic displays of all potentiometers except those assigned to a specified assignment.

20. The improvement according to claim 14 or claim 16, wherein said electrically-alterable displays are also capable of displaying other numeric data.

21. In a lighting console providing outputs to dimming means, said console including:

(a) master controls for at least two scenes;

(b) channel controls for each of a plurality of channels, said channel controls including at least a first and second preset potentiometer, said channel controls and said master controls cooperating to allow presetting;

(c) a plurality of means for producing an output, each associated with one of said plurality of channels, said means for producing an output located in proximity to said channel controls;

(d) means for selectively coupling associated with each of said means for producing an output;

(e) at least one conductor coupled to the output of each of a plurality of said means for selectively coupling;

(f) at least one device at a remote location having at least one serial input coupled to said conductor;

(g) means providing sequential outputs to operate said plurality of means to selectively couple, whereby the output of a plurality of said means for producing may be detected in a sequence at said input of said remote device, the improvement comprising:

(h) said means for selectively coupling distributed to a plurality of locations within the console, each such location in substantially similar proximity to its associated means for producing an output, such that said conductor connecting said means for selectively coupling with said remote device forms an elongated serial buss.

22. The improvement according to claim 21, wherein said means for producing an output comprise the combined outputs of at least the first and second channel potentiometers.

23. The improvement according to claim 21, wherein said means for producing an output comprises a switch.

24. The improvement according to claim 21, wherein said means for producing an output comprises a device maintaining a digitally-encoded value.

25. The improvement according to claim 21, and further including a fault isolating means connected between said elongated serial buss and at least one of said means for selectively coupling whereby the effects of faults causing the output of said means for selectively coupling to be connected by a low-impedance path to ground, or to a more negative voltage do not disrupt the operation of said buss as it relates to means for selectively coupling connected to other fault isolating means.

26. The improvement according to claim 25, wherein said fault isolating means comprises a diode.

27. The improvement according to claim 25, wherein said fault isolating means comprises a precision half-wave rectifier.

28. The improvement according to claim 25, wherein said means for producing an output and said means for selectively coupling occupy a common mechanical module.

29. The improvement according to claim 28, wherein a separate mechanical module is provided for each channel.

30. In a lighting console providing outputs to dimming means, said console including:

(a) master controls for at least two scenes; and (b) channel controls for each of a plurality of channels, said channel controls including at least a first and second preset potentiometer, said channel controls and said master controls cooperating to allow presetting;

(c) at least one device at a remote location producing at least one serial output;

(d) a serial buss comprising at least one conductor coupled to said output of said remote device;

(e) a plurality of means for storing an input signal for each one of a plurality of channels, each coupled to said buss;

(f) a plurality of means responsive to an output each one of a plurality of channels, each coupled to said means for storing;

(g) means providing outputs to sequentially operate said means for storing to sequentially sample said serial buss, the improvement comprising:

(h) said means for storing distributed to a plurality of locations within the console, each such location in substantially similar proximity to said means responsive to an output, such that the conductor connecting said means for storing with said remote device forms an elongated serial buss.

31. The improvement according to claim 30, wherein the output of said means for storing is combined with the outputs of at least said first and second preset potentiometers.

32. The improvement according to claim 30, wherein said means responsive to an output comprises an indicator.

33. The improvement according to claim 30, wherein said means responsive to an output comprises a device accepting a digitally-encoded value.

34. The improvement according to claim 33, said channel controls further including a numeric display, wherein said means responsive to an output drives said numeric display.

35. The improvement according to claim 30, and further including a fault isolating means connected between said elongated serial buss and said means for storing of at least one channel whereby the effects of a fault developed after said fault isolating means will not disrupt the operation of channels connected to other fault isolating means.

36. The improvement according to claim 35, wherein said fault isolating means comprises a resistor.

37. The improvement according to claim 36, and further including an amplifier, wherein the value of said resistor is selected such that the failure of said amplifier will not disrupt the operation of the serial buss as it relates to the means for storing of channels connected to other fault isolating means.

38. The improvement according to claim 35, wherein said means responsive to an output and said means for storing occupy a common mechanical module.

39. The improvement according to claim 38, wherein a separate mechanical module is provided for each channel.

* * * * *

UNITED STATES PATENT AND TRADEMARK OFFICE

CERTIFICATE OF CORRECTION

PATENT NO. : 4,550,276

DATED : October 29, 1985

INVENTOR(S) : Michael Callahan and Robert M. Goddard

It is certified that error appears in the above-identified patent and that said Letters Patent is hereby corrected as shown below:

Column 11, line 9, after "739", delete "B".

Column 15, line 11, change "31" to --131--.

Column 20, line 53, after "output", insert --for--.

Signed and Sealed this

Eleventh Day of November, 1986

*Attest:*

DONALD J. QUIGG

*Attesting Officer* *Commissioner of Patents and Trademarks*